United States Patent [19]

Kett

[11] Patent Number: 4,865,010

[45] Date of Patent: Sep. 12, 1989

[54] EXHAUST DUCT COOLING SYSTEM FOR BUILT-IN GAS OVEN

[75] Inventor: David J. Kett, Butler Township, Montgomery County, Ohio

[73] Assignee: Whirlpool Corporation, Benton Harbor, Mich.

[21] Appl. No.: 292,545

[22] Filed: Dec. 30, 1988

[51] Int. Cl.[4] ..... A21B 1/00; F24C 15/32

[52] U.S. Cl. ..... 126/21 R; 126/273 A; 219/413; 219/391

[58] Field of Search ..... 126/19 R, 21 R, 214, 126/273 R, 273 A; 219/413, 391

[56] References Cited

U.S. PATENT DOCUMENTS

| | | | |
|---|---|---|---|
| Re. 29,602 | 4/1978 | Perl | 126/21 A |
| 3,485,229 | 12/1969 | Gilliom | 126/21 |
| 3,659,578 | 5/1972 | Davis et al. | 126/21 R |
| 3,882,843 | 5/1975 | Barnett | 126/273 |
| 3,924,601 | 12/1975 | Nuss | 126/21 |
| 4,180,049 | 12/1979 | Carr et al. | 126/21 |
| 4,331,124 | 5/1982 | Seidel et al. | 126/21 |
| 4,354,084 | 10/1982 | Husslein et al. | 219/10.55 |
| 4,373,504 | 2/1983 | Day | 126/21 |
| 4,375,213 | 3/1983 | Kemp et al. | 126/21 |
| 4,392,038 | 7/1983 | Day et al. | 219/10.55 |
| 4,395,233 | 7/1983 | Smith et al. | 432/176 |
| 4,598,691 | 7/1986 | Herrelko et al. | 126/41 |
| 4,601,279 | 7/1986 | Guerin | 126/21 |

*Primary Examiner*—Carroll B. Dority, Jr.

*Attorney, Agent, or Firm*—Hill, Van Santen, Steadman & Simpson

[57] ABSTRACT

An exhaust duct cooling system is provided for a built-in gas oven wherein cool air is drawn into the oven enclosure and through an oven controls area to cool that area, and then the cool air is directed into a cool air duct which is positioned between the oven cooking cavity and an oven exhaust duct to thermally isolate the controls area while cooling the oven exhaust. The cool air duct has a first, lower outlet below the oven controls, and a second, upper outlet adjacent to an outlet of the oven exhaust duct where cool air and oven exhaust are mixed in a chamber prior to exiting the oven cabinet. Thus, the oven exhaust is tempered prior to being exhausted from the front of the oven.

20 Claims, 2 Drawing Sheets

EXHAUST DUCT COOLING SYSTEM FOR BUILT-IN GAS OVEN

BACKGROUND OF THE INVENTION

The present invention relates to gas ovens, and more particularly to a built-in gas oven and an exhaust duct cooling system therefore.

Gas ovens are heated by the combustion of natural gas within the cooking chamber and in order for such combustion to occur and continue, air must be continuously supplied to the heating chamber and exhausted therefrom. In the case of a built-in gas oven, because of the surrounding cabinetry, generally the exhaust gases are ducted to the front of the oven unit and are caused to exit therefrom into the room or are directly vented to a location outside of the room or outside of the building. Front venting is preferred as it is less expensive to install, however, because of the high temperature of the combustion gases, generally it is required to insulate the exhaust duct work both from the electrical components of the oven controls as well as from the surrounding cabinetry. Exhaust temperatures are normally as high as internal oven surface temperatures and can cause problems of excessively high oven surface temperatures and fire potential on wood cabinet surfaces in proximity of the exhaust.

U.S. Pat. No. 3,485,229 to Gilliom discloses a built-in oven having ducting which draws cool air from the lower front of the oven, circulates it over the oven cavity and through a motor-fan located rearwardly above the oven cavity. Fan exhaust air is then directed horizontally over a horizontal oven exhaust duct, then over the oven controls and out vents located on the upper right front of the oven. Oven exhaust air is vented through vents located on the upper left front of the oven. No provision is made for mixing relatively cool air with oven exhaust air at the front of the oven, nor is the horizontal oven exhaust duct physically separated from the oven control area by a cool air duct.

U.S. Pat. No. 3,882,843 to Barnett, discloses a built-in oven which draws cool air through gaps on all four exterior sides of the oven cabinet. A motor-fan located in the lower rear of the oven cabinet propels the cool air around the exterior sides of the oven cavity, and over an intermediate passage which overlies the oven cavity. This cooling air is then exhausted through gaps located at the top and sides of the oven.

A horizontal intermediate passage located between an upper control chamber and the oven cavity provides a portion of the cool intake air for circulation around the oven cavity. This intermediate passage overlies a horizontal oven exhaust duct and provides a buffer of cool air between the oven control chamber and the oven exhaust duct.

Although this oven provides the feature of physically separating a horizontal oven exhaust duct from the oven control area by a cool air duct, no provision is made for mixing cooling air with hot oven exhaust air at the front of the oven, nor is this feature suggested.

U.S. Pat. No. 4,375,213 to Kemp, et al., discloses a built-in oven having ducting which draws cool air from an air intake in the lower front of the oven. One or more blowers located in a lower air chamber propel the cool air into a vertical duct located in the rear of the oven, which directs the cool air above and below a horizontal air baffle located between the oven cavity and the oven control area. Cooling air is then exhausted through openings in the front of the oven cabinet above and beneath the oven control panel.

The horizontal air baffle also overlies a horizontal oven exhaust duct which exhausts hot gases from the oven cavity. By providing ducted flow of cooling air over the oven exhaust duct, the horizontal air baffle effectively provides a buffer of cool air between the oven exhaust duct and the oven control area. A critical difference, however, is the fact that the control area is located above the cooling air duct in this oven design, not below the cooling duct. Accordingly, natural convection within the oven may cause excessive heating of the oven controls.

Further, the cooling air exhaust openings in Kemp, et al. overlies the hot oven exhaust duct openings, whereby the hot oven exhaust is mixed with and cooled by the cooling air after it is emitted from the front of the oven cabinet. The mixing occurs exteriorly of the oven and the mixed exhaust air is emitted directly at the user. Additionally, the oven exhaust opening and the cool air exhaust openings are not coextensive for the entire width of the oven, which reduces the effectiveness of the air mixing. Further, since the mixed exhaust air is emitted beneath the control panel, the heated mixed air may rise by convection to create unacceptably high temperatures on the control panel faceplate and knobs.

SUMMARY OF THE INVENTION

The present invention provides an improved exhaust duct cooling system for a built-in gas oven which achieves the desireable results of reducing electrical component temperatures in the proximity of the exhaust duct and reduces the effective exhaust temperature at the exhaust exit location. This improvement both eliminates the need and expense of insulating the oven exhaust ducts and reduces the effective exhaust temperature at the oven front.

Room temperature air is supplied to the oven cabinet interior from rearward facing apertures in the oven cabinet top, and is circulated over and around the upwardly sloping exhaust duct and oven control area. The exhaust duct is of a lesser width than the oven cabinet, and is centrally located therein. A fan-motor assembly mounted on a sheet metal floor beneath the exhaust duct and behind the oven control panel draws air over the top and around the sides of the exhaust duct and expels the air into a horizontal cool air duct through a circular duct intake opening in the sheet metal floor.

From the duct intake opening, air is directed both forwardly and rearwardly inside the horizontal cool air duct. A portion of the cool air is vented through exhaust openings in the front of the oven located beneath the oven controls, and the remainder of the cool air is directed rearwardly to a vertical cool air duct. The vertical cool air duct shares a common wall with a vertical oven exhaust expansion chamber, so that cool air circulates over the exterior of the front wall of the vertical oven exhaust expansion chamber.

The vertical exhaust expansion chamber is fed by a vertical oven exhaust duct, which emits hot oven exhaust from an opening located at the upper rear of the oven cavity. The vertical oven exhaust duct is centrally located on the oven cavity and is rectangular in cross-section, so that it may be conveniently fitted to a rectangular, centrally located hot exhaust intake aperture located on the floor of the oven exhaust expansion chamber.

Upon reaching the top of the oven exhaust expansion chamber, hot oven exhaust is directed forwardly into a large, upwardly sloping oven exhaust duct, the floor of which defines the ceiling of an adjoining cool air duct. The adjoining cool air duct below the oven exhaust duct performs the dual functions of cooling the hot oven exhaust and providing a buffer between the oven controls and the hot oven exhaust duct.

After traveling the length of the upwardly sloping oven exhaust duct, oven exhaust air is vented through an elongated horizontal aperture at the front of the oven behind a decorative escutcheon panel. Immediately beneath the exhaust duct aperture is a similarly dimensioned horizontal aperture for exhausting relatively cool air. Relatively cool air mixes with hot oven exhaust air, thereby reducing the overall exhaust air temperature. The volume of cool air through the upper vent is balanced by the volume of air forced out the lower cool air exhaust vent. The mixed air and exhaust is forced upwardly between the escutcheon and the kitchen wall, so that hot air is not expelled directly onto the face or body of the user.

In addition to the above-stated desirable results, other benefits of this exhaust cooling design are that it reduces outer cabinet temperatures and eliminates the need to insulate the oven exhaust duct to protect the oven controls from excessive temperatures. Additionally, the mixed oven exhaust is expelled from the oven above the control panel faceplate and knobs, eliminating the possibility of creating excess control panel surface temperatures.

DESCRIPTION OF THE PREFERRED EMBODIMENTS

Figure 1:
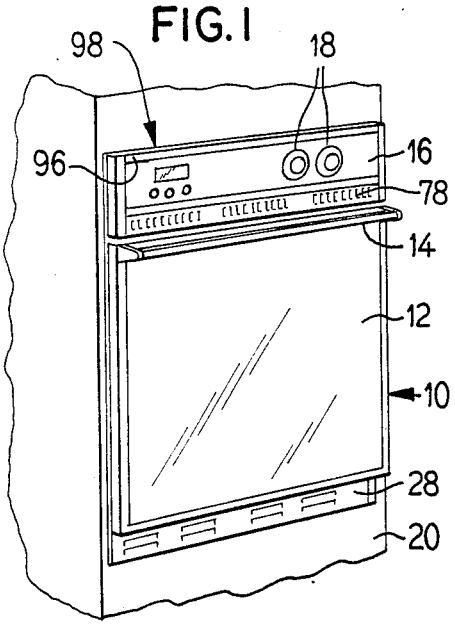
FIG. 1 is a perspective view of a built-in single gas oven embodying the principles of the present invention.
Figure 2:
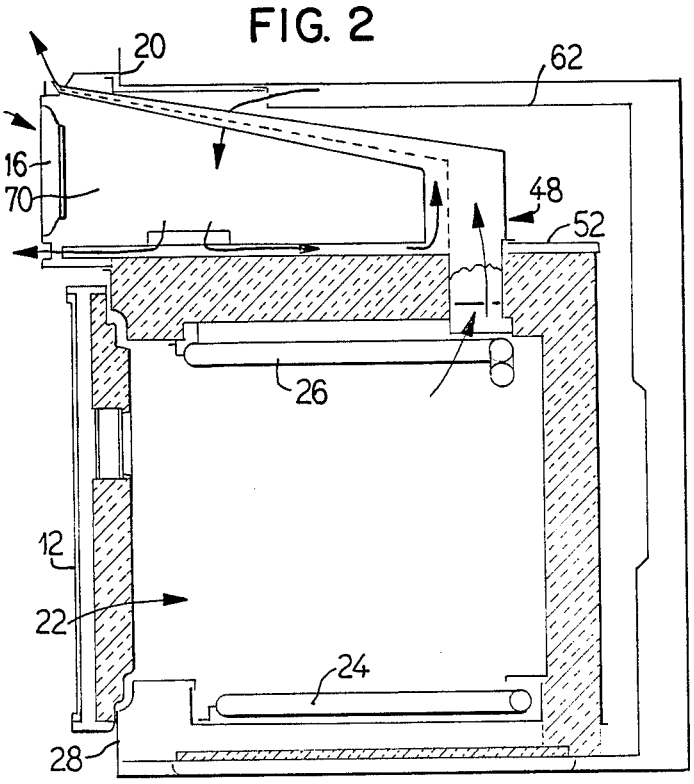
FIG. 2 is a side sectional view of the gas oven of FIG. 1.

In FIG. 1 there is illustrated a built-in gas oven generally at 10 which includes an openable front door 12 having a handle 14 at a top side thereof below a control panel 16 having a plurality of control knobs 18 thereon. The oven 10 is surrounded on all sides, except for the front side, by cabinetry or walls 20 such that only the front side of the oven 10 is exposed. Such an oven is shown in greater detail in FIG. 2 where it is seen that the oven 10 includes a large cooking cavity 22 which can be accessed through the door 12. Gas burners 24, 26 are provided in the cooking chamber 22 to provide heat for baking or broiling as selected by control knobs 18. Air is drawn into the cooking chamber 22 through an apertured grill 28 provided along a lower front edge of the oven and exhaust gases are carried in an exhaust duct 30 illustrated in greater detail in FIGS. 4–6.

Figure 3:
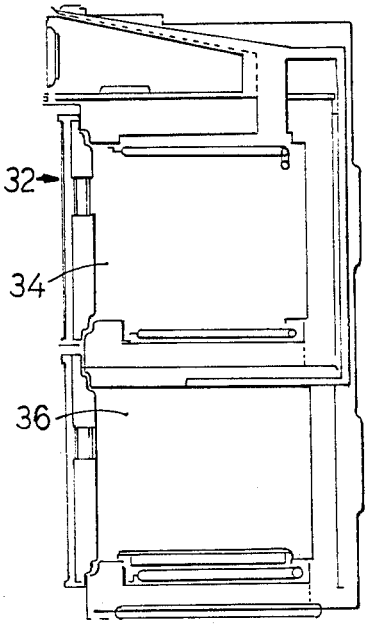
FIG. 3 is a side sectional view of a double gas oven embodying the principles of the present invention.

FIG. 3 illustrates a double oven construction 32 having an upper cooking cavity 34 and a lower cooking cavity 36. In virtually all respects pertinent to the present invention such a construction would operate in the same manner as that of a single oven construction and therefore the exhaust duct 30 arrangement will be described in detail only for the single oven construction.

Figure 5:
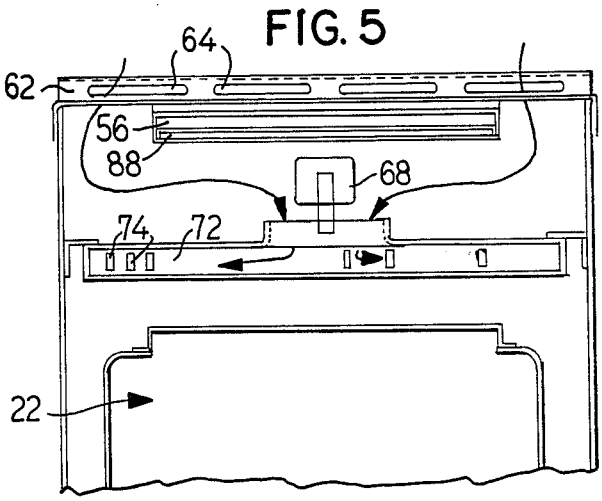
FIG. 5 is a sectional view taken generally along the line V—V of FIG. 4.
Figure 6:
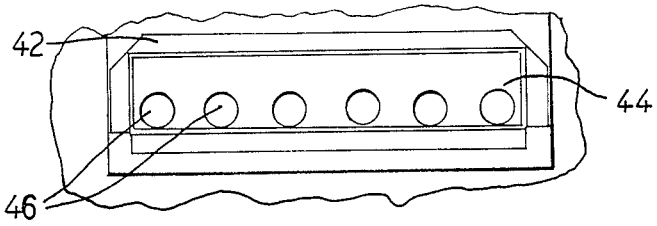
FIG. 6 is a sectional view taken generally along the line VI—VI of FIG. 4.
Figure 4:
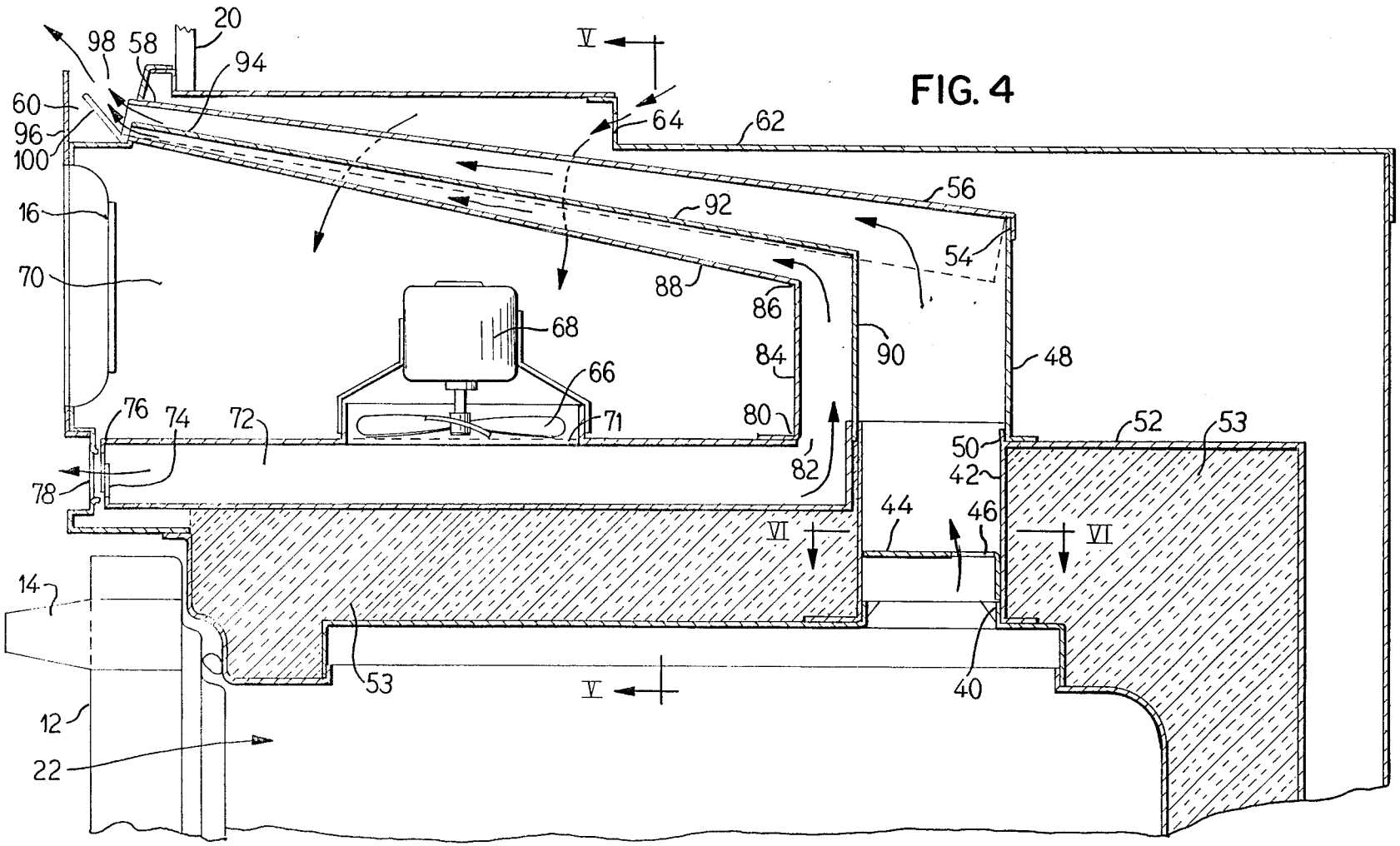
FIG. 4 is an enlarged sectional view of the exhaust duct cooling system of FIG. 2.

In FIGS. 4–6 the exhaust arrangement is shown in greater detail. Referring specifically to FIG. 4, it is seen that the cooking cavity 22 has an opening 40 located at the upper rear of the cooking cavity through which hot oven exhaust can exit the oven cavity. A rectangular vertical oven exhaust duct 42 is connected to the oven opening 40 to direct exhaust gases vertically. Positioned in the vertical oven exhaust duct 42 is a baffle plate 44 (also shown in FIG. 6) which has a plurality of apertures 46 therethrough for restricting the flow of exhaust air through the exhaust duct 42.

The vertical oven exhaust duct 42 is connected to a vertical exhaust expansion chamber 48 which is also rectangular and centrally located. Both the vertical oven exhaust duct 42 and the vertical exhaust expansion chamber 48 are received in a rectangular opening 50 in a shroud 52 surrounding the oven. The shroud 52 contains a layer of insulation 53 which surrounds the cooking cavity 22.

A top end 54 of the vertical exhaust expansion chamber 48 is connected to an upwardly sloping oven exhaust duct 56 having a generally rectangular shape with a width less than the width of the oven, as seen in FIG. 5. A forward end 58 of the sloping oven exhaust duct 56 opens into a chamber 60 above the control panel 16 at the front of the oven 10.

A supply of relatively cool air is provided for thermally isolating and cooling the sloping oven exhaust duct 56. This supply of relatively cool air is drawn in through an outer shroud or external cabinet of the oven 62 through a plurality of openings 64 formed in a top portion of the shroud 62, the shroud having a width the same as the oven 10, which, as described above, is greater than the width of the sloping oven exhaust duct 56.

A fan 66 driven by an electric motor 68 causes relatively cool air to be drawn in through the openings 64 in the outer shroud 62, which air flows around the sloping oven exhaust duct 56 thereby both thermally isolating that duct and cooling it as well. The air flows through a chamber 70 which houses the electrical controls for the oven, thus protecting the oven controls from excessive temperatures. The air is pushed by the fan 66 through a circular duct intake opening 71 into a horizontal cool air duct 72 which has a plurality of openings 74 at a forward end 76 thereof to permit a portion of the air flow to exit through a grill 78 at the front of the oven 10, below the control panel 16 and above the door 12. This air is still relatively cool, having only picked up a minimal amount of heat by flowing past the sloping of the exhaust duct 56 and through the electrical controls area 70. A rear end 80 of the horizontal cool air duct 72 is open at 82 and is connected to a vertical cool air duct 84 which in turn communicates at a top end 86 thereof to an upwardly sloping cool air duct 88.

The vertical cool air duct 84 shares a common wall 90 with the vertical oven exhaust expansion chamber 48 such that cool air in the duct 84 circulates over the exterior of the front wall 90 of the vertical oven exhaust chamber 48 providing an initial cooling of the hot oven exhaust. Further, a ceiling wall 92 of the upwardly sloping cool air duct 88 comprises a floor of the upwardly sloping oven exhaust duct 56 and the width of the upwardly sloping cool air duct 88 is the same as the upwardly sloping oven exhaust duct 56 such that the upwardly sloping cool air exhaust duct 88 performs the dual functions of cooling the hot oven exhaust and providing a buffer between the oven controls in chamber 70 and the hot oven exhaust duct 56.

The upwardly sloping cool air exhaust duct 88 has an open forward end 94 which also opens into chamber 60 positioned behind an escutcheon plate 96 such that the relatively cool air flowing in the cool air duct 88 mixes with the relatively hot exhaust air flowing in exhaust duct 56 thereby reducing the overall exhaust air temperature which exits through an elongated opening 98 formed between the escutcheon 96 and the kitchen wall 20 and which is directed upwardly. A deflector plate 100 is located within the chamber 60 to assist in mixing the cool and hot air and directing the mixed air upwardly so that it will not be expelled directly onto the face or body of the oven user.

The volume of cool air which is directed through the upper vent 98 is balanced by the volume of air forced out through the lower cool air exhaust vent 78, the excessive air flow, which is directed through the cool vent 78 assists in keeping the electrical control chamber 70 relatively cool.

Thus it is seen that the present invention provides for a cool air duct which is positioned between the oven controls area and the oven cavity and oven exhaust duct to thermally isolate the controls area from the high temperatures of the oven cavity and oven exhaust duct. Further, cool air is continuously drawn through the oven controls area to keep that area cool. Finally, relatively cool air is mixed with the oven exhaust, within the oven enclosure, so that the final front exhaust is tempered. This exhaust, also, is above the oven control panel to prevent excessive heat build-up in that area and the exhaust is directed upwardly so that it is not directed at the oven user.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. An exhaust duct cooling system for a built-in gas oven having an oven cooking cavity with an openable door on a front side thereof and a control panel with a plurality of electrical controls mounted thereon and therebehind, said control panel being located above said door, said oven including an external shroud enclosing said oven cooking cavity, said exhaust duct cooling system comprising:

an opening at a top rear area of said oven cooking cavity;

an oven exhaust duct communicating with said oven cavity opening and having a portion extending vertically upwardly and a portion sloping upwardly and forwardly and having an opening at a top forward end thereof above said control panel;

said oven exhaust duct having a width less than a width of said external shroud;

a plurality of air inlet openings in said shroud above said oven exhaust duct;

a first, horizontal cool air duct positioned above said cooking cavity and below said oven exhaust duct and below said control panel;

means for drawing cool air in through said shroud air inlet openings and causing said air to flow into said horizontal cool air duct;

said horizontal cool air duct having an air exhaust opening at a forward end thereof communicating with said front side of said oven below said control panel and an opening at a rear side thereof;

a second cool air duct communicating with said first, horizontal cool air duct at said rear side opening thereof, said second cool air duct having a portion extending vertically upwardly and a portion sloping upwardly and forwardly and having an opening at a top forward end thereof above said control panel;

said second cool air duct vertical portion having a rear wall comprising a front wall of said oven exhaust duct vertical portion and said second cool air duct sloping portion having a top wall comprising a floor of said oven exhaust duct sloping portion; and a chamber formed in said oven above said control panel in which said openings at said top forward ends of said sloping portions of said exhaust duct and second cool air duct are located, said chamber having an exhaust opening communicating with the exterior of said oven.

2. An exhaust duct cooling system according to claim 1, wherein said means for drawing air comprises a motor driven fan positioned in an opening in said horizontal cool air duct communicating with a space interior of said exterior shroud.

3. An exhaust duct cooling system according to claim 1, wherein said chamber opening directs mixed cool air and oven exhaust upwardly.

4. An exhaust duct cooling system according to claim 1, wherein said second cool air duct has a width equal to the width of said oven exhaust duct.

5. An exhaust duct cooling system according to claim 1, wherein said chamber is formed behind an escutcheon plate and said chamber opening is in a top wall of said chamber.

6. An exhaust duct cooling system according to claim 1, wherein a deflector plate is located in said chamber to assist in mixing said cool air and said oven exhaust and directing the mixed air upwardly.

7. An exhaust duct cooling system according to claim 1, wherein a baffle plate is positioned in said vertical portion of said oven exhaust duct.

8. An exhaust duct cooling system for a built-in gas oven having an oven cooking cavity with an openable door on a front side thereof and a control panel with a plurality of electrical controls mounted thereon and therebehind, said control panel being located above said door, said oven including an external shroud enclosing said oven cooking cavity and an electrical control area above said oven cooking cavity, said exhaust duct cooling system comprising:

an opening at a top rear area of said oven cooking cavity;

an oven exhaust duct communicating with said oven cavity opening and extending vertically behind and forwardly above said electrical controls area and having an opening at a top forward end thereof above said control panel;

at least one air inlet opening in said shroud above said oven exhaust duct;

a cool air duct surrounding said electrical controls area on a bottom side, a rear side and a top side;

means for drawing cool air in through said shroud air inlet opening and causing said air to flow into said cool air duct;

said cool air duct having an air exhaust opening at a bottom forward end thereof communicating with said front side of said oven below said control panel and an air exhaust opening at a top forward end thereof above said control panel;

said cool air duct being positioned between said electrical controls area and said oven exhaust duct; and a chamber formed in said oven above said control panel in which said openings at said top forward ends of said exhaust duct and cool air duct are located, said chamber having an exhaust opening communicating with the exterior of said oven.

9. An exhaust duct cooling system according to claim 8, wherein said means for drawing air comprises a motor driven fan positioned in an opening in said cool air duct communicating with said electrical controls area.

10. An exhaust duct cooling system according to claim 8, wherein said chamber opening directs mixed cool air and oven exhaust upwardly.

11. An exhaust duct cooling system according to claim 10, wherein said chamber is formed behind an escutcheon plate and said chamber opening is in a top wall of said chamber.

12. An exhaust duct cooling system according to claim 10, wherein a deflector plate is located in said chamber to assist in mixing said cool air and oven exhaust and directing the mixed air upwardly.

13. An exhaust duct cooling system according to claim 8, wherein said oven exhaust duct and said cool air duct have a width less than a width of said external shroud.

14. An oven comprising:

at least one oven cooking cavity with an openable door on a front side thereof;

a control panel located above said door with a plurality of electrical controls mounted thereon and therebehind;

an external shroud enclosing said oven cooking cavity and an electrical controls area above said oven cooking cavity;

an oven exhaust duct communicating with said oven cavity and extending vertically behind and forwardly above said electrical controls area and having an opening at a top forward end thereof above said control panel;

at least one air inlet opening in said shroud above said oven exhaust duct;

a cool air duct positioned between said electrical controls area and said oven cavity and said one exhaust duct;

means for drawing cool air in through said shroud air inlet opening and causing said air to flow into said cool air duct;

said cool air duct having an air exhaust opening at a bottom forward end thereof communicating with said front side of said oven below said control panel and an air exhaust opening at a top forward end thereof above said control panel;

means for mixing oven exhaust from said oven exhaust duct and cool air from said cool air duct prior to exhausting said exhaust from said oven.

15. An oven according to claim 1, wherein said means for mixing oven exhaust and cool air comprises a chamber formed in said oven above said control panel in which said openings at said top forward ends of said exhaust duct and cool air duct are located, said chamber having an exhaust opening communicating with the exterior of said oven.

16. An exhaust duct cooling system according to claim 14, wherein said means for drawing air comprises a motor driven fan positioned in an opening in said cool air duct communicating with said electrical controls area.

17. An exhaust duct cooling system according to claim 15, wherein said chamber opening directs mixed cool air and oven exhaust upwardly.

18. An exhaust duct cooling system according to claim 17, wherein said chamber is formed behind an escutcheon plate and said chamber opening is in a top wall of said chamber.

19. An exhaust duct cooling system according to claim 17, wherein a deflector plate is located in said chamber to assist in mixing said cool air and oven exhaust and directing the mixed air upwardly.

20. An exhaust duct cooling system according to claim 14, wherein said oven exhaust duct and said cool air duct have a width less than a width of said external shroud.

* * * * *